US009163408B2

(12) United States Patent
West

(10) Patent No.: US 9,163,408 B2
(45) Date of Patent: Oct. 20, 2015

(54) SILICONE ROOF EDGE ACCESSORY FOR FOAM ROOF AND ASSOCIATED METHOD

(71) Applicant: Richard A. West, Lakewood, OH (US)

(72) Inventor: Richard A. West, Lakewood, OH (US)

( * ) Notice: Subject to any disclaimer, the term of this patent is extended or adjusted under 35 U.S.C. 154(b) by 0 days.

(21) Appl. No.: 14/079,290

(22) Filed: Nov. 13, 2013

(65) Prior Publication Data

US 2014/0130447 A1 May 15, 2014

Related U.S. Application Data

(60) Provisional application No. 61/725,803, filed on Nov. 13, 2012.

(51) Int. Cl.

| | |
|---|---|
| ***E04D 13/00*** | (2006.01) |
| ***E04D 13/15*** | (2006.01) |
| ***E04D 13/16*** | (2006.01) |

(52) U.S. Cl.

CPC ..... *E04D 13/15* (2013.01); *E04D 13/1668* (2013.01); *E04D 13/1681* (2013.01); *Y10T 428/24504* (2015.01); *Y10T 428/24777* (2015.01)

(58) Field of Classification Search

CPC . E04D 13/15; E04D 13/1681; E04D 13/1668; E04D 7/00

USPC ..... 52/58, 97, 273, 287.1, 309.2–309.7, 52/309.13, 716.2, 717.01, 717.03, 717.05, 52/745.06, 745.11

See application file for complete search history.

(56) References Cited

U.S. PATENT DOCUMENTS

| | | | | |
|---|---|---|---|---|
| 4,244,151 | A * | 1/1981 | Seem | 52/60 |
| 5,524,404 | A * | 6/1996 | Lahaye | 52/235 |
| 5,670,178 | A | 9/1997 | West | |
| 6,036,123 | A | 3/2000 | West | |
| 6,101,767 | A * | 8/2000 | Georgeau | 52/62 |
| 6,981,657 | B1 | 1/2006 | West | |
| 2007/0234669 | A1 * | 10/2007 | Gembala | 52/410 |
| 2011/0167756 | A1 * | 7/2011 | Klein | 52/745.15 |

* cited by examiner

*Primary Examiner* — Patrick Maestri
(74) *Attorney, Agent, or Firm* — Fay Sharpe LLP

(57) ABSTRACT

A foam roof of the present disclosure includes a roof having a roof portion with one of an edge, termination, or penetration having a generally upright edge. A foam is received over a region of the roof portion adjacent to and along the generally upright edge. A flexible edge member is received over the generally upright edge and an adjacent region of the foam. The edge member preferably has first and second legs disposed in substantially perpendicular relation, and each leg has a variable or tapering cross-sectional conformation.

17 Claims, 5 Drawing Sheets

110

SILICONE ROOF EDGE ACCESSORY FOR FOAM ROOF AND ASSOCIATED METHOD

This application claims the priority benefit of U.S. provisional application Ser. No. 61/725,803, filed Nov. 13, 2012, the details of which are expressly incorporated herein by reference.

BACKGROUND

The present disclosure relates to the roof industry, and particularly plastic foam applied to a roofing deck or other surface to provide an essentially seamless roof.

It is well-known to apply a plastic foam, such as a polyurethane foam, to a roofing deck. The foam typically includes two components which, when mixed together, react to create exothermic heat. By adding a blowing agent, the exothermic reaction causes the mixture of the components to expand and thereby trap a blowing agent in cells to produce a plastic foam having excellent insulating and other desirable properties for use as a roofing material. The chemicals are typically a liquid form that is heated and pumped under pressure where the chemicals are mixed in a spray gun, the gun or nozzle directing the materials against the roof surface where the material cures in a short period of time.

In another manner of application, the plastic foam chemicals are mixed and dispensed onto a roof deck ahead of a moving wall. The wall is spaced above the deck and cooperates with a side containment structure or foam block to define the vertical thickness and lateral width of a strip of plastic foam applied to the roof deck. This application method reduces overspray issues and optimizes the utilization of the foam material. Further details of various methods and apparatus for applying such foam plastic material to a roof deck are shown and described in commonly owned patents U.S. Pat. No. 5,670,178; U.S. Pat. No. 6,036,123; and U.S. Pat. No. 6,981,657, the disclosures of which are incorporated herein by reference.

A common problem in the foam roofing industry results from an edge of the roof metal pulling away from the foam, or cracks developing due to movement in the structure. The gaps or cracks create a potential leak path that is unsightly and unfortunately a potential path of moisture ingress can develop beneath the foam. Gaps or cracks can also occur not only at the roof edge, but at other termination locations or other areas of the roof such as where structures including drains, stacks, penetrations, protrude from the roof, or expansion joints and other elevation changes in the roof. These regions are most prone to leaks.

One common way to correct the gap or crack is to form a "V-groove" that is subsequently filled with a sealant. As one skilled in the art will appreciate, this is a labor-intensive process, and likewise costly. Moreover, these remedial efforts are not always effective. Still further, the resulting effort is still not very attractive.

Consequently, a need exists for a low-cost, easy to install solution that addresses these various issues in roof areas that are most prone to leaking. The solution relates to an accessory and method of forming a foam roof that incorporates the accessory.

BRIEF DESCRIPTION

A foam roof includes a roof edge, termination, or penetration having a generally upright edge. A foam is received over a region of the roof portion adjacent to and along the generally upright edge. A flexible edge member is received over the generally upright edge and an adjacent region of the foam.

The roof further includes a sealant interposed between the flexible edge member and the foam.

In one preferred arrangement, the flexible edge member is a silicone material, and may be a silicone adhesive.

In a preferred arrangement, the flexible edge member has a generally longitudinal, first portion of variable cross-section that increases as the flexible edge member extends toward the generally upright edge.

In one embodiment, the variable cross-section is a tapering cross-sectional conformation.

In one embodiment, the flexible edge member has first and second legs disposed in substantially perpendicular relation.

The first and second legs increase in cross-sectional thickness as each leg extends toward the other leg.

The flexible edge member preferably has an extrudable cross-sectional conformation.

A method of forming a foam roof on a roof surface includes mounting a foam stop on the roof surface. The method further includes applying a foam over preselected regions of the roof surface, including over an upper surface of the foam stop. The method also includes installing an edge member over a preselected portion of the foam and foam stop.

The installing step includes adhering a first leg of the edge member to the preselected portion of the foam.

The installing step includes providing a silicone sealant between the preselected portion of the foam and the edge member.

The method further includes applying a top coat over at least a portion of an upper surface of the edge member and at least a portion of the foam adjacent the edge member.

The edge member installing step includes orienting a first leg of the edge member over the preselected portion of the foam, and positioning a second leg of the edge member adjacent a vertically extending portion of the foam stop.

In one embodiment, the first and second legs are disposed in substantially perpendicular relation to one another and the installing step includes positioning the first leg over and securing the first leg with a silicone material to a perimeter portion of the foam adjacent the foam stop.

A primary benefit is the provision of a roof that is aesthetically pleasing.

Another benefit resides in the ease with which potential crack and leak paths may be resolved.

Still another benefit resides in the ability to conform to irregularities in the roof structure.

Yet another advantage is the ease of installation with a silicone sealant/adhesive.

Still another advantage resides in the ability to provide a straight edge and adapt the arrangement to sheet form, as well as waterproofing and strengthening other areas of the roof such as drains, stacks, penetrations, expansion joints, elevation changes, etc.

Other benefits and advantages will become apparent to those skilled in the art upon reading and understanding the following detailed description.

DETAILED DESCRIPTION

Figure 1:
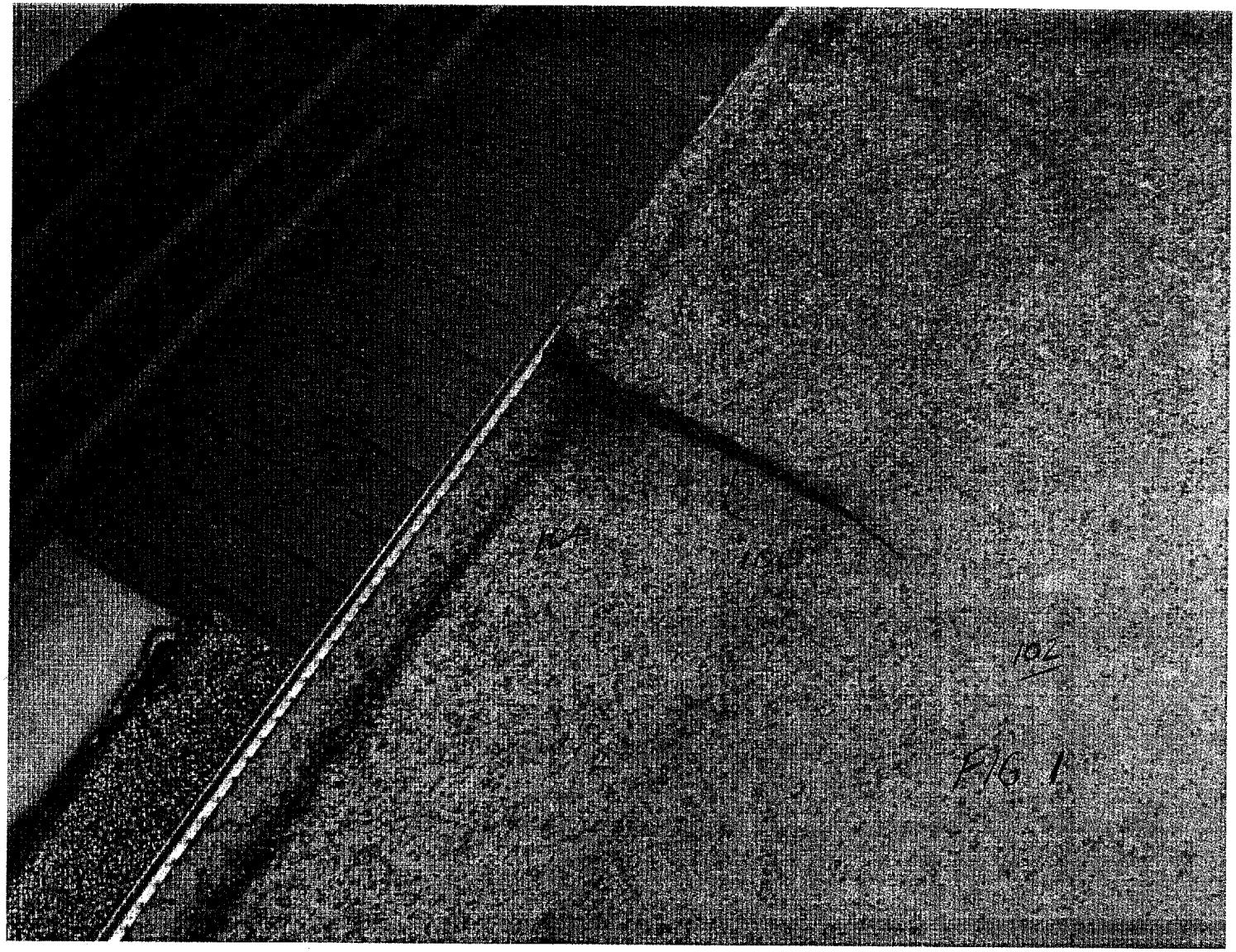
FIGS. 1-3 are images showing resulting cracks that form in a foam roof along a roof edge, termination, or at other penetration locations.
Figure 2:
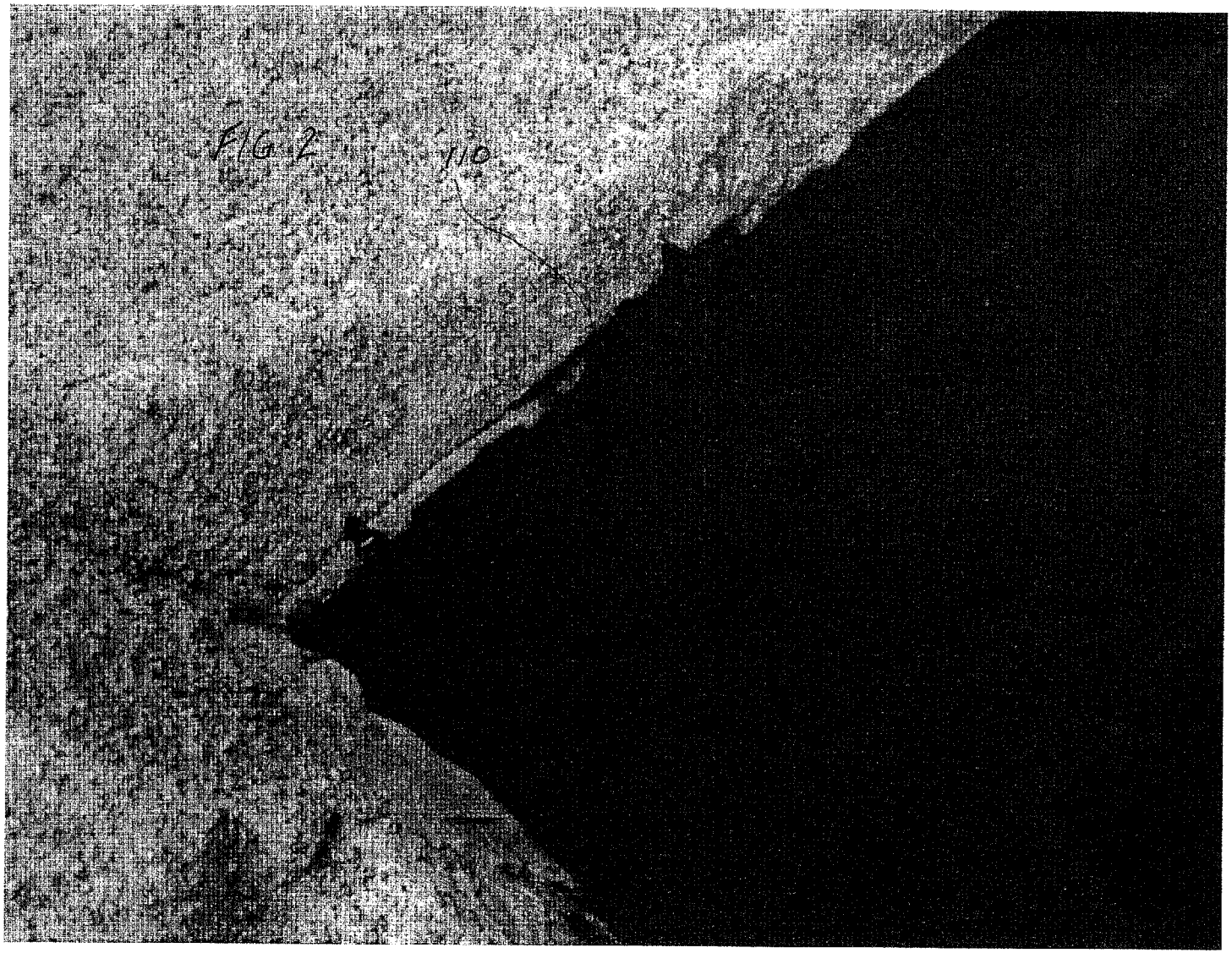
Figure 3:
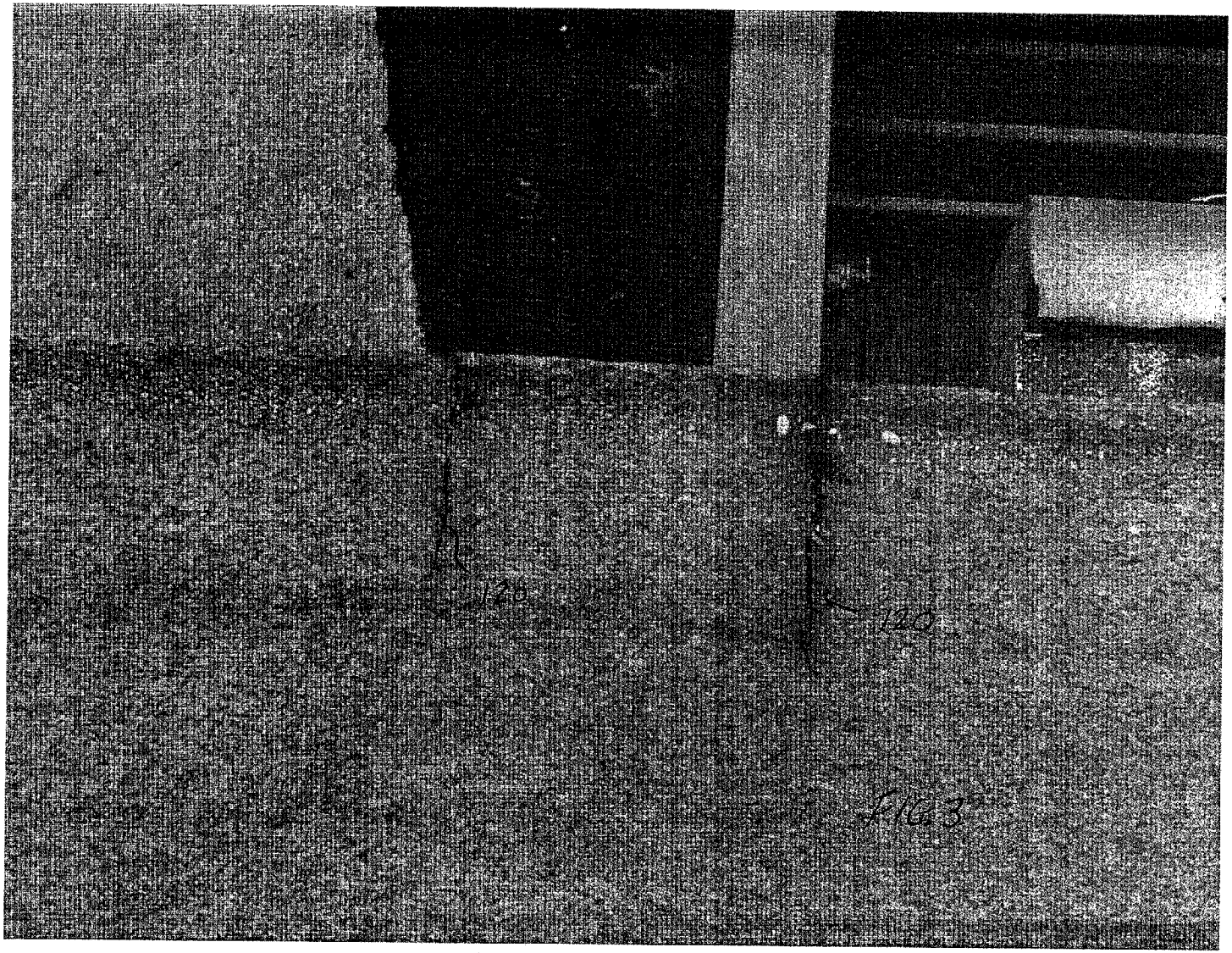

With reference to FIGS. 1-3, various roof structures are shown and exhibit a crack or gap in the roof structure that is unsightly, and potentially leads to water leaks. For example, FIG. 1 shows a crack 100 that starts along a perimeter edge where the foam 102 separates from a metal foam stop 104. Remedial efforts, as noted above, include forming a groove such as a V-groove and the subsequently filling the groove with a sealant. For example, a silicone sealant is desirable for use as a fill material or sealant because of the expansion properties of the material, waterproof characteristics, and ability of the silicone sealant to seal against a wide variety of surfaces. Of course other conventional fill materials or sealants could be used in an effort to fix the crack or potential leak path. FIG. 2 illustrates a foam edge 110 pulling away from the metal along a roof structure. Likewise, FIG. 3 shows cracks 120 formed in another roofing environment.

Figure 5:
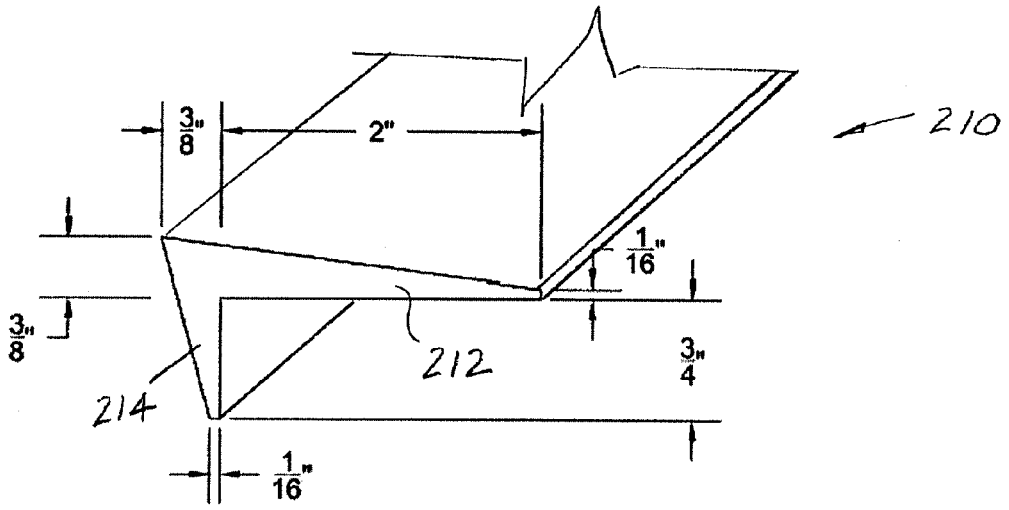
FIG. 5 is a perspective view of an edge member or accessory used in the foam roof of FIG. 4.
Figure 4:
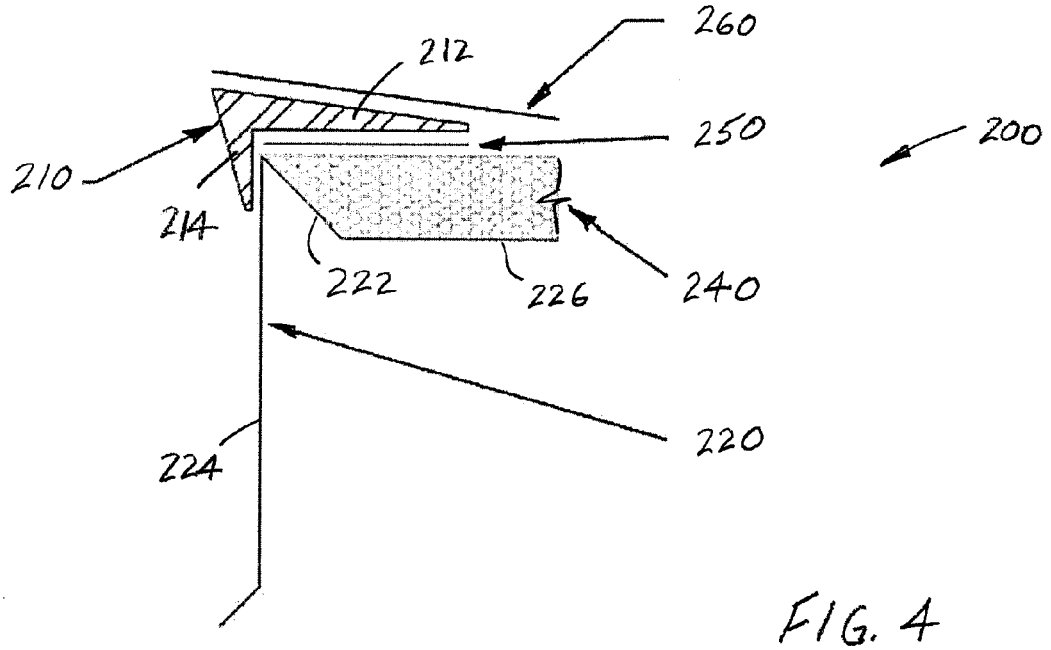
FIG. 4 is a cross-sectional view through a foam roof according to the present disclosure.
Figure 6:
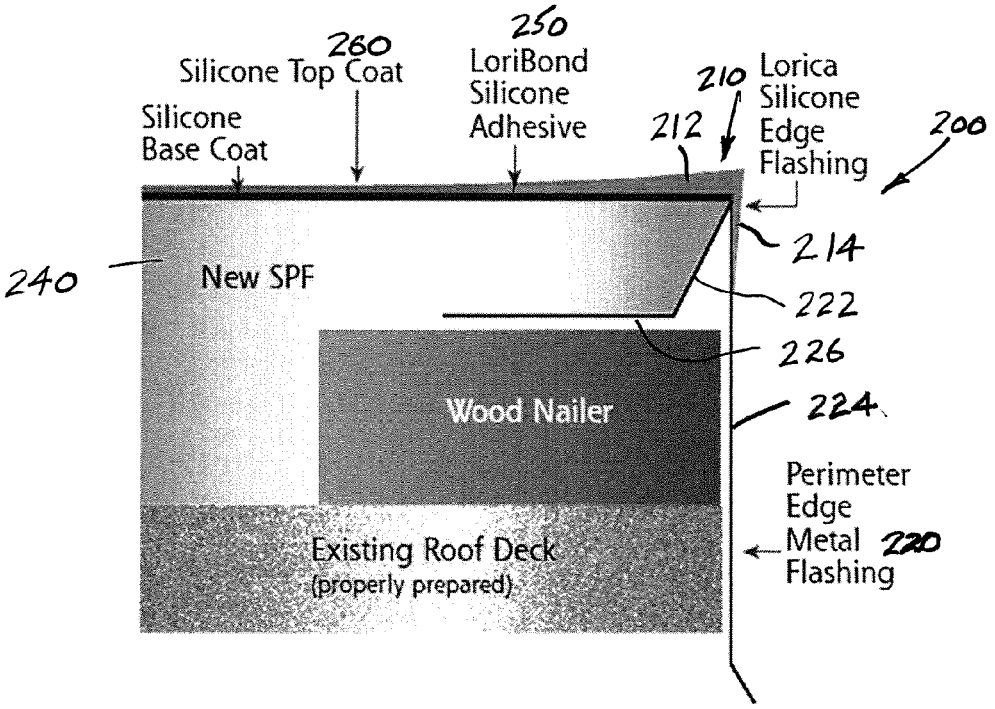
FIG. 6 is another view of the edge member of FIGS. 4 and 5.

FIGS. 4-6 show a foam roof 200 that incorporates a roof edge accessory 210 that is also referenced in the following description as a flexible edge member, termination, or penetration accessory for the foam roof. In one preferred arrangement, the edge member 210 is an elongated, strip-like structure and may adopt a wide variety of configurations. One such configuration of the edge member 210 includes a first leg 212 that is generally disposed in substantially perpendicular relation to a second leg 214. Each of the first and second legs 212, 214 preferably has a variable cross-sectional thickness. This need not be the case in all end uses of the edge member 210 but finds particular application when used along a perimeter of a foam roof. The variable cross-sectional thickness in each leg 212, 214 of the edge member 210 desirably increases in thickness as each leg extends toward the other leg. In other words, the edge member 210 preferably has the largest cross-sectional thickness at the intersection of the first and second legs 212, 214. When used along the perimeter of the foam roof 200, this provides a tapering conformation that flows toward a central portion of the roof, i.e. away from the perimeter. Likewise, the conformation of the edge member 210 provides a desired sharp cutoff in a vertical direction where the second leg 214 tapers inwardly toward a vertical face of the structure.

With reference to FIGS. 4-6, a foam stop 220 is secured to the underlying support structure. The foam stop 200 may be typically formed as a thin metal structure (or sometimes referred to as a perimeter edge metal flashing) that includes a tapered surface 222 that extends downwardly and away from vertical face 224 and merges into planar surface 226. The combined tapered surface 222 and planar surface 226 are preferably limited to the perimeter of the foam roof 200 or other regions where a stop or control of the foam applied to the roof structure is desired. A foam or foam layer 240 is only partially illustrated in FIG. 5 since it is understood that the foam desirably extends over the remainder of the upper surface of the roof structure. Here, the foam 240 is applied in a manner such as described in one of the commonly owned U.S. patents identified in the Background. Of course, still other foam materials and methods of application could be used without departing from the scope and intent of the present disclosure.

Once the foam stop 220 is secured in place, and the foam 240 applied over the upper surface of the roof structure, the edge member 210 is then mounted to the foam roof. One preferred way to secure the edge member 210 is to provide a sealant or adhesive material 250 that is interposed between the foam 240 and the edge member 210 at the desired location. Thus, a region of the foam 240 adjacent the perimeter edge has the sealant/adhesive 250 applied to the upper surface of the foam. The edge member 210, and more particularly the first leg 212, is then secured to the foam roof by bringing the first leg in contact with the sealant/adhesive 250. The second leg 214 of the edge member preferably abuts against the outer surface of vertical face 224 of the foam stop 220.

Subsequently, a top coat 260 is received over a portion of the edge member 210. The top coat preferably extends past the terminal end of the first leg 212 and over a portion of the upper surface of the foam 240 spaced inwardly from the edge member 210. In this way, the interface among the foam 240, sealant/adhesive 250, and first leg 212 of the edge member 210 is hidden from view by the top coat 260. Since cracks typically develop in a roof along these perimeter regions or adjacent locations of drains, stacks, penetrations, or other structures that extend into or extend out of the roof, or due to other elevation changes in the roof, the edge member 210, sealant/adhesive 250, and top coat 260 provide additional protection against potential leaks as a result of any crack or gap that may form.

Additionally, the edge member 210 is preferably formed of a silicone material that is designed to be particularly flexible. By way of example, the silicone material may exhibit flexibility properties on the order of 700% elongation. Simultaneously, the silicone material used to form the edge member 210 is preferably a tough material, having a tensile strength on the order of 1600 psi. In addition, the silicone edge member 210 has a soft or flexible nature allowing the edge member to conform to irregularities in the roof structure (such as irregularities in the foam stop 220 and/or foam 240) which the edge member covers. The silicone edge member 210 is easy to install with the silicone sealant/adhesive 250 and provides an aesthetically pleasing, controlled or straight edge as may be desired for a particular end use. The silicone edge member 210 is manufactured at low cost, and one preferred manner of manufacture is to extrude the silicone edge member so that cross-sectional profiles that are easily extruded are desired. The edge member 210 can be provided in sheet form or other forms and the edge member desirably aids in waterproofing and strengthening characteristics for the perimeter edges as well as other areas of the foam roof 200. One skilled in the art will appreciate, however, that the edge member 210 is not limited to use only along the perimeter of the roof structure. The edge member 210 may also be advantageously used around drains, stacks, penetrations, or other structures that extend into or extend out of the foam roof 200.

FIG. 5 provides representative dimensions associated with one preferred form of a roof edge member 210. These dimensions are intended to be exemplary only and not deemed to be limiting. Nevertheless, the dimensions demonstrate that the edge member 210 is typically intended for use along a minor portion of the overall roof structure. In one arrangement, the edge member 210 is provided as a sheet product that is approximately two inches to eight inches wide (about 2" to 8" wide). The edge member 210 includes the detail described above and may include a peel-and-stick adhesive as an option, although this is not a requirement.

The exemplary embodiment has been described with reference to the preferred embodiments. Obviously, modifications and alterations will occur to others upon reading and understanding the preceding detailed description. It is intended that the exemplary embodiments be construed as including all such modifications and alterations in so far as they come within the scope of the appended claims or the equivalents thereof.

The invention claimed is:

1. A foam roof including:

a roof includes a roof portion including one of an edge, termination, or penetration having a generally upright edge;

a foam received over a region of the roof portion adjacent to and along the generally upright edge;

a silicone material edge member received over the generally upright edge and an adjacent region of the foam; and a silicone adhesive sealant received on a surface of the foam and solely securing the edge member to the foam; wherein a second leg of the edge member tapers inwardly toward the generally upright edge of the roof portion, away from a first leg.

2. The foam roof of claim 1 wherein the edge member has a generally longitudinal, first portion of variable cross-section that increases in thickness as the edge member extends toward the generally upright edge.

3. The foam roof of claim 2 wherein the edge member first portion has a tapering cross-sectional conformation.

4. The foam roof of claim 2 wherein the edge member first portion has a width of approximately two inches.

5. The foam roof of claim 1 wherein the edge member has first and second legs disposed in substantially perpendicular relation.

6. The foam roof of claim 1 wherein the edge member has an extrudable profile that exhibits at least one of flexibility (up to 700% elongation) and high strength (1600 psi tensile strength).

7. The foam roof of claim 1 further comprising a top coat received over a portion of the edge member.

8. A foam roof including:

a roof portion including one of an edge, termination, or penetration having a generally upright edge;

a foam received over a region of the roof portion adjacent to and along the generally upright edge; and an edge member received over the generally upright edge and an adjacent region of the foam, wherein the edge member has first and second legs disposed in substantially perpendicular relation and the first leg increases in cross-sectional thickness as the first leg extends toward the second leg.

9. The foam roof of claim 8 wherein the second leg increases in cross-sectional thickness as the second leg extends toward the first leg.

10. The foam roof of claim 8 further including a sealant interposed between the edge member and the foam.

11. The foam roof of claim 10 wherein the edge member is a silicone material.

12. The foam roof of claim 11 wherein the sealant is a silicone adhesive.

13. The foam roof of claim 8 wherein the edge member is a silicone material.

14. The foam roof of claim 8 wherein the second leg of the edge member tapers inwardly toward the generally upright edge of the roof portion.

15. A method of forming a foam roof on a roof surface comprising:

mounting a foam stop on the roof surface;

applying a foam over preselected regions of the roof surface, including over an upper surface of the foam stop;

installing a silicone material edge member, wherein the edge member has first and second legs disposed in substantially perpendicular relation to one another, over a preselected portion of the foam and foam stop, including orienting a first leg of the edge member over the preselected portion of the foam where the first leg increases in cross-sectional thickness as the first leg proceeds toward the second leg, and positioning the second leg of the edge member adjacent a vertically extending portion of the foam stop; and adhering the first leg of the silicone edge member to the foam with a silicone adhesive sealant applying a top coat over at least a portion of an upper surface of the edge member and at least a portion of the foam adjacent the edge member.

16. The method of claim 15 further comprising applying a top coat over at least a portion of an upper surface of the edge member and at least a portion of the foam adjacent the edge member.

17. The method of claim 15 further including tapering the $2^{nd}$ leg of the edge member inwardly toward the vertically extending portion of the foam stop.

* * * * *